US006764419B1

(12) United States Patent
Giannetti et al.

(10) Patent No.: US 6,764,419 B1
(45) Date of Patent: Jul. 20, 2004

(54) COMPOSITE BASEBALL BAT HAVING AN INTERFACE SECTION IN THE BAT BARREL

(75) Inventors: William B. Giannetti, Woodland Hills, CA (US); Hsing-Yen Chuang, Studio City, CA (US); Dewey Chauvin, Simi, CA (US)

(73) Assignee: Jas D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/336,130

(22) Filed: Jan. 3, 2003

(51) Int. Cl.[7] ..... A63B 59/06
(52) U.S. Cl. ..... 473/567
(58) Field of Search ..... 473/567, 566

(56) References Cited

U.S. PATENT DOCUMENTS

| | | | | | |
|---|---|---|---|---|---|
| 1,611,858 | A | | 12/1926 | Middlekauff | |
| 4,931,247 | A | * | 6/1990 | Yeh | 264/258 |
| 5,301,940 | A | * | 4/1994 | Seki et al. | 473/567 |
| 5,364,095 | A | | 11/1994 | Easton et al. | |
| 5,395,108 | A | * | 3/1995 | Souders et al. | 473/567 |
| 5,415,398 | A | | 5/1995 | Eggiman | |
| 5,511,777 | A | | 4/1996 | McNeely | |
| 5,624,115 | A | * | 4/1997 | Baum | 473/567 |
| 5,676,610 | A | | 10/1997 | Bhatt et al. | |
| 5,899,823 | A | | 5/1999 | Eggiman | |
| 6,042,493 | A | * | 3/2000 | Chauvin et al. | 473/566 |
| 6,053,828 | A | | 4/2000 | Pitsenberger | |
| 6,344,007 | B1 | * | 2/2002 | Feeney et al. | 473/567 |
| 6,352,485 | B1 | * | 3/2002 | Philpot et al. | 473/564 |
| 6,383,101 | B2 | | 5/2002 | Eggiman et al. | |
| 6,425,836 | B1 | * | 7/2002 | Misono et al. | 473/567 |

OTHER PUBLICATIONS

U.S. patent application Ser. No. 10/167,094, Buiatti et al., filed Oct. 17, 2002.

* cited by examiner

*Primary Examiner*—Mark S. Graham
(74) *Attorney, Agent, or Firm*—Perkins Coie LLP

(57) ABSTRACT

A ball bat includes a barrel, a handle, and a tapered section joining the barrel to the handle. The barrel includes an outer wall and an interface section located within the outer wall. The interface section includes one or more layers of non-resin-impregnated fabric sandwiched between a plurality of resin-impregnated composite layers. A method of constructing a ball bat includes the steps of placing a substantially cylindrical layer of fabric between a plurality of resin-impregnated layers to form an interface section. The interface section is placed between a plurality of substantially cylindrical outer wall sections made up of a plurality of composite plies. Heat and pressure are applied to the interface section and the composite plies to induce a flow of resin from the resin-impregnated layers into the fabric layer, and to form an integral bat barrel. The interface section provides added durability and "trampoline effect" to bat.

22 Claims, 2 Drawing Sheets

COMPOSITE BASEBALL BAT HAVING AN INTERFACE SECTION IN THE BAT BARREL

BACKGROUND OF THE INVENTION

Baseball and softball bats have been in use for many years. These bats typically include a handle, a barrel, and a tapered section joining the handle to the barrel. The outer shell of these bats is generally formed with aluminum or another suitable metal or composite construction.

Barrel construction is particularly important in modern bat design. Barrels having a single-wall construction, and more recently, a multi-wall construction, have been developed. Modern bats typically include a hollow interior, such that the bats are relatively lightweight and allow a ball player to generate substantial "bat speed" or "swing speed."

Single-wall barrels generally include a single tubular spring within the barrel. Multi-wall barrels typically include two or more tubular springs, or similar structures, that may be of the same or different material composition, within the barrel. The tubular springs in these multi-wall bats are either in contact with one another, such that they form friction joints, are bonded to one another with weld or bonding adhesive, or are separated from one another forming frictionless joints. If the tubular springs are bonded using a structural adhesive, or other structural bonding material, the barrel is essentially a single-wall construction. U.S. Pat. No. 5,364,095, the disclosure of which is herein incorporated by reference, describes a variety of bats having multi-walled barrel constructions.

It is generally desirable to have a bat barrel that is durable, while also exhibiting optimal performance characteristics. Hollow bats typically exhibit a phenomenon known as the "trampoline effect," which essentially refers to the rebound velocity of a ball leaving the bat barrel as a result of flexing of the barrel wall(s). Thus, it is desirable to construct a bat having a high "trampoline effect," so that the bat may provide a high rebound velocity to a pitched ball upon contact.

The "trampoline effect" is a direct result of the compression and resulting strain recovery of the barrel. During this process of barrel compression and decompression, energy is transferred to the ball resulting in an effective coefficient of restitution (COR) of the barrel, which is the ratio of the post impact ball velocity to the incident ball velocity (COR= Vpost impact/Vincident). In other words, the "trampoline effect" of the bat improves as the COR of the bat barrel increases.

Multi-walled bats were developed in an effort to increase the amount of acceptable barrel deflection beyond that which is possible in typical single-wall designs. These multi-walled constructions generally provide added deflection without increasing stress beyond the material limits of the barrel materials. Accordingly, multi-walled designs are often preferred to single-wall designs, since they typically produce a better "trampoline effect."

In general, as the wall thickness or barrel stiffness is increased in a bat barrel, the COR decreases. It is important to maintain a sufficient wall thickness, however, because the durability of the bat typically decreases if the wall is too thin. Thus, if the barrel wall(s) are too thin, the barrel may be subject to denting, in the case of metal bats, or to progressive material failure, in the case of composite bats. As a result, the performance and lifetime of the bat may be reduced if the barrel wall(s) are not thick enough.

In the case of composite bats, moreover, the bat barrels are generally characterized by a very high resin content. This high resin content often limits the elastic properties of the bat barrel. Thus, although these bats have performed relatively well, the "trampoline effect" that they exhibit is generally limited by the high resin content in the bat barrels. Thus, there exists a significant design challenge to construct a bat that exhibits significant "trampoline effect" in conjunction with high durability.

SUMMARY OF THE INVENTION

The invention is directed to a ball bat having an interface section having one or more layers of non-resin-impregnated fabric sandwiched between a plurality of resin-impregnated layers in a wall of the bat barrel, and a method of making the same.

In a first aspect, a ball bat includes a barrel, a handle, and a tapered section joining the barrel to the handle. The barrel has an outer wall including a substantially cylindrical outer layer, a substantially cylindrical inner layer, and an interface section located between and integral with the outer layer and the inner layer. The interface section includes one or more layers of fabric sandwiched between a plurality of resin-impregnated composite plies, wherein the layer of fabric includes resin that flowed from the plurality of resin-impregnated composite plies during curing of the bat.

In another aspect, a method of constructing a ball bat includes the steps of placing a substantially cylindrical layer of substantially dry fabric between a plurality of resin-impregnated layers to form a substantially cylindrical interface section. The interface section is then placed between a plurality of substantially cylindrical wall sections that each include one or more composite plies. Heat and pressure are then applied to the interface section and the composite plies to induce a flow of resin from the resin-impregnated layers into the fabric layer, and to form an integral bat barrel made up of the wall sections and the interface section.

In another aspect, a method of constructing a ball bat includes the steps of rolling an inner wall section onto a substantially cylindrical mandrel, rolling a bond inhibiting layer onto the inner wall section, and rolling an inner layer of an outer wall section onto the bond inhibiting layer. A first resin-impregnated reinforcement layer is then rolled onto the inner layer of the outer wall section, after which a substantially dry layer of fabric is rolled onto the first resin-impregnated reinforcement layer. Next, a second resin-impregnated reinforcement layer is rolled onto the fabric layer, and an outer layer of the outer wall section is rolled onto the second resin-impregnated reinforcement layer. Heat and pressure are then applied to the layers to induce a flow of resin from the first and second resin-impregnated reinforcement layers into the fabric layer, and to form an integral bat barrel.

In another aspect, a ball bat includes a barrel, a handle, and a tapered section joining the barrel to the handle. The barrel includes a substantially cylindrical outer wall. A substantially cylindrical interface section, including one or more layers of previously non-resin-impregnated fabric sandwiched between a plurality of resin-impregnated layers, is located in the outer wall of the barrel. The layer of fabric includes resin that flowed from the plurality of resin-impregnated layers during curing of the bat.

Further embodiments, including modifications, variations, and enhancements of the invention, will become apparent. The invention resides as well in subcombinations of the features shown and described.

BRIEF DESCRIPTION OF THE DRAWINGS

In the drawings, wherein the same reference number indicates the same element throughout the several views.

DETAILED OF DESCRIPTION OF THE DRAWINGS

A ball bat has an interface section including one or more layers of non-resin-impregnated fabric sandwiched between a plurality of resin-impregnated layers in a wall of the bat barrel. Other steps and features described below may be advantageous but are not necessarily essential to the invention.

Figure 1:
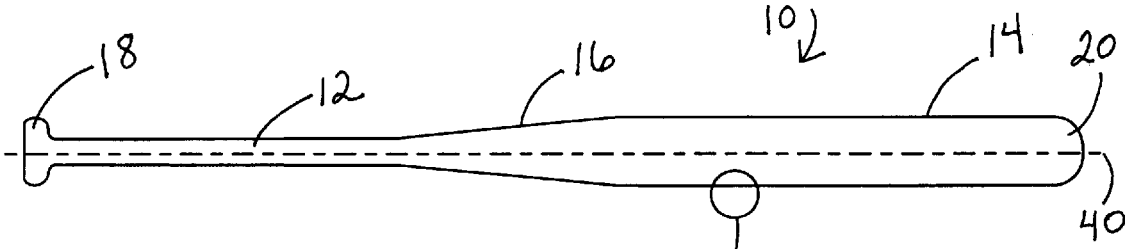
FIG. 1 is a perspective view of a ball bat.
Figure 3:
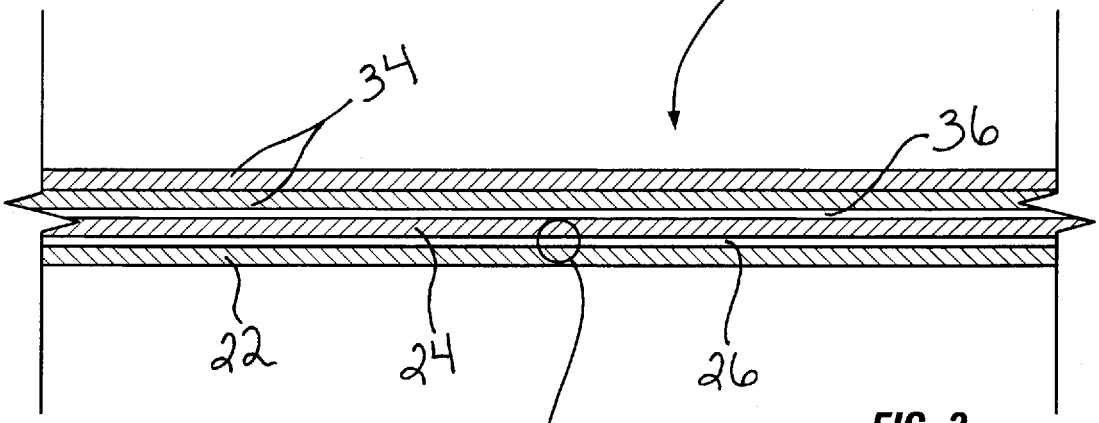
FIG. 3 is a close up sectional view of the indicated section of FIG. 1, illustrating the barrel layers shown in FIG. 2.

Turning now in detail to the drawings, as shown in FIG. 1, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior 38 of the bat 10 is preferably hollow about a central axis 40, which allows the bat to be relatively lightweight so that ball players may generate substantial bat speed when swinging the bat 10.

The bat 10 preferably has an overall length of 20 to 40 inches, more preferably 26 to 34 inches. The overall barrel diameter is preferably 2.0 to 3.0 inches, more preferably 2.25 to 2.75 inches. Typical bats have diameters of 2.25, 2.69, or 2.75 inches. Bats having various combinations of these overall lengths and barrel diameters are contemplated herein. The specific preferred combination of dimensions of a bat 10 is generally dictated by the user of the bat 10, and may vary greatly between users.

The present invention is primarily directed to the ball striking area of the bat 10, which typically extends throughout the length of the barrel 14, and which may extend partially into the tapered section 16 of the bat 10. For ease of description, this striking area will generally be referred to as the "barrel" throughout the remainder of the description.

As illustrated in FIGS. 2–5, the barrel 14 is made up of several substantially cylindrical layers. The actual shape of each of the barrel layers may vary according to the desired shape of the overall barrel structure. Accordingly, "substantially cylindrical" will be used herein to describe cylindrical barrel layers, as well as other similar common barrel shapes. An outer barrel wall preferably includes an outer layer 22 and an inner layer 24. Each layer 22, 24 is preferably made up of one or more plies of a composite material. Alternatively, the outer and/or inner layers 22, 24 of the outer barrel wall may include a metallic material, such as aluminum or titanium.

Figure 4:
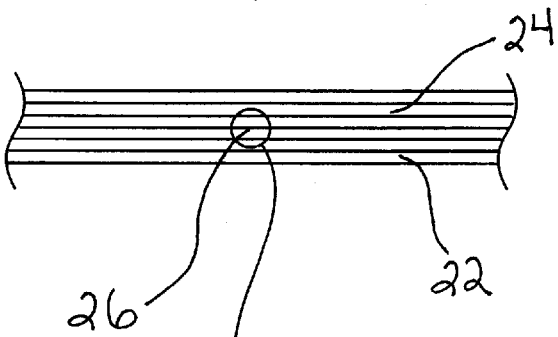
FIG. 4 is a close up sectional view of the indicated section of FIG. 3, illustrating a plurality of the layers of the outer barrel wall.

In the embodiment illustrated in FIG. 4, each of the outer and inner layers 22, 24 includes a plurality of composite plies. The composite material is preferably fiber-reinforced, and may include glass, graphite, boron, carbon, aramid, ceramic, kevlar, and/or any other suitable reinforcement material. The overall radial thickness of each layer 22, 24 is preferably approximately 0.005 to 0.020 inches, more preferably 0.010 to 0.015 inches.

Figure 5:
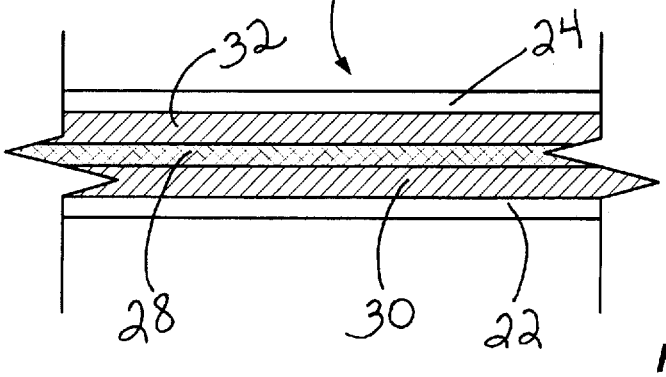
FIG. 5 is a close up sectional view of the indicated section of FIG. 4, illustrating a preferred interface section in the outer barrel wall.
Figure 2:
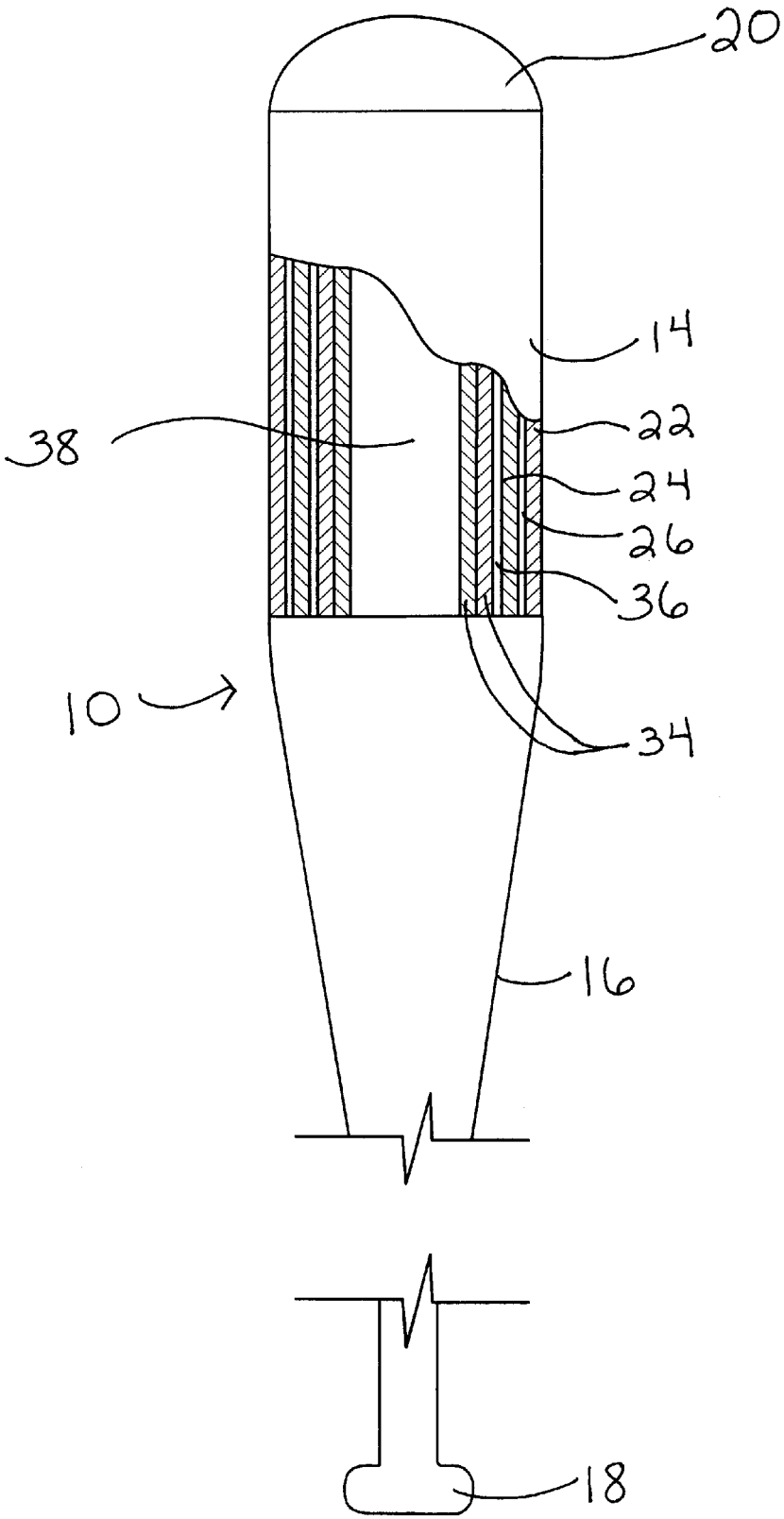
FIG. 2 is a perspective partially cutaway view of a ball bat.

The outer and inner layers 22, 24 of the outer barrel wall are separated by and preferably integral with an interface section 26. As is best illustrated in FIG. 5, the interface section 26 includes at least one inner layer 28 sandwiched between two reinforcing layers 30, 32. The inner layer 28 is preferably a fabric or similar material, and has a radial thickness of approximately 0.005 to 0.015 inches, more preferably 0.008 to 0.012 inches. Before curing of the bat 10 is performed, the inner fabric layer 28 is preferably substantially dry and not impregnated with resin.

The two reinforcing layers 30, 32 preferably each include one or more plies of a composite material impregnated with resin. Each reinforcing layer 30, 32 preferably has a radial thickness of approximately 0.002 to 0.010 inches, more preferably 0.004 to 0.006 inches. In a preferred embodiment, the two reinforcing layers 30, 32 each include one or more plies of resin-impregnated unidirectional composite tape. The composite tape, or other composite material, is preferably fiber-reinforced, and may include glass, graphite, boron, carbon, aramid, ceramic, kevlar, and/or any other suitable reinforcement material.

During curing of the bat 10, which is described in detail below, heat and pressure are applied to the barrel structure. This heating and pressurizing process causes resin to flow from the resin-impregnated layers 30, 32 into the fabric layer 28. As a result, the interface section 26 becomes a unified sandwich structure that is integral with the surrounding layers 22, 24 of the outer barrel wall. The resulting barrel structure, as a whole, has an extremely low resin content compared to conventional composite barrels that do not employ such an interface section. The integral barrel layers function in a manner similar to that of a typical leaf spring. Accordingly, the barrel 14 exhibits relatively high elastic properties compared to conventional composite barrels, and, in turn, exceptional elastic performance, "trampoline effect," and durability.

In a preferred embodiment, the barrel 14 also includes an inner barrel wall, giving the barrel a "multi-wall" design. The inner barrel wall is located adjacent to and surrounded by the outer barrel wall. The inner barrel wall may be separated from the outer barrel wall by a bond-inhibiting layer 36, which prevents the inner and outer barrel walls from bonding to one another during curing of the bat 10. The bond-inhibiting layer 36 preferably has a radial thickness of approximately 0.001 to 0.004 inches, more preferably 0.002 to 0.003 inches.

The inner barrel wall is preferably made up of one or more layers 34 of a composite material. The composite material is preferably fiber-reinforced, and may include glass, graphite, boron, carbon, aramid, ceramic, kevlar, and/or any other suitable reinforcement material. Alternatively, the layers 34 of the inner barrel wall may be a metallic material, such as aluminum or titanium.

In a preferred embodiment, the outer layer 22 of the outer barrel wall has a radial thickness substantially equal to that of the inner layer 24 of the outer barrel wall. As a result, the interface section 26 is located substantially at a radial midpoint of the outer barrel wall. Thus, in a single-wall configuration, the interface section 26 is located at approximately one half the overall radial wall thickness measured from an outer surface of the barrel wall.

In a double-wall design, the inner barrel wall preferably has a radial thickness substantially equal to that of the outer barrel wall. Accordingly, when the interface section 26 is located substantially at a radial midpoint of the outer barrel wall, the interface section 26 is located at approximately one quarter the combined radial wall thickness of the outer barrel wall and the inner barrel wall measured from an outer surface of the outer barrel wall. The relative thickness of each of the layers, and the resulting relative location of the interface section 26, may vary based on design considerations relating to bulk modulus, shear strength of the resin employed, minimum elongation of the fibers employed, etc.

To construct the bat 10, the various layers of the bat 10 are preferably pre-cut and pre-shaped with conventional machinery. In general, the bat 10 is constructed by placing one or more substantially cylindrical layers 28 of substantially dry fabric between a plurality of resin-impregnated layers 30, 32 to form a substantially cylindrical interface section 26. The interface section 26 is then placed between two substantially cylindrical outer wall sections 22, 24, each made up of one or more composite plies.

If a double-wall construction is desired, the outer wall sections are positioned around a substantially cylindrical inner wall section made up of one or more composite plies 34. In a preferred embodiment, a bond-inhibiting layer 36 may be placed between the inner and outer wall sections.

Once all of the layers are arranged, heat and pressure are applied to the layers to cure the bat 10. The heat and pressure induce a flow of resin from the resin-impregnated composite layers 30, 32 of the interface section 26 into the fabric layer 28 of the interface section 26. This flow of resin occurs because the relative pressure in the resin-impregnated layers 30, 32 is greater than the pressure in the dry fabric layer 28. As the resin flows from the reinforcing layers 30, 32, these layers 30, 32 become stiffer. Accordingly, the overall barrel 14 is generally stiffer than barrels found in conventional composite bats that do not employ such an interface section 26. This increased stiffness provides excellent load transfer between the multiple barrel layers, which enhances the "trampoline effect" of the bat barrel 14.

The flow of resin into the fabric layer 28 transforms the interface section 26 into a unified sandwich structure that is integral with the other barrel layers. This unified sandwich structure, as a whole, has a very low resin content. Accordingly, the overall resin content of the barrel 14 itself is much lower than that of conventional composite bats that do not employ such an interface section 26. As a result, the bat barrel 14 has improved elastic properties, which further enhances the "trampoline effect."

In general, the bat 10 is constructing by rolling the various layers of the bat 10 onto a mandrel or similar structure having the desired bat shape. The ends of the layers are preferably "clocked" or offset from one another so that they do not all end in the same location. Accordingly, when heat and pressure are applied to cure the bat 10, the various layers blend into a unique single-wall construction. Put another way, all of the layers of the bat are "co-cured" in a single step, resulting in a single wall structure with no gaps, such that the barrel 14 is not made up of a series of tubes with a wall thickness that terminates at the ends of the tubes. As a result, the interface section 26 is integral to the barrel structure, and all of the layers act in unison under loading conditions, such as during striking of a ball.

The blending of the layers into a single-wall construction, like tying the ends of a leaf spring together, offers an extremely durable assembly, particularly when impact occurs at the extreme ends of the layer separation zones. By blending the multiple layers, together, the barrel 14 acts as a unitized structure where no single layer works independently of the other layers. As a result, stress is redistributed to the extreme regions of the interface section 26, which reduces localized stress, thus increasing the overall durability of the bat barrel 14.

In a preferred embodiment, the bat 10 is constructed as follows. First, the various layers of the bat 10 are pre-cut and pre-shaped with conventional machinery. An inner wall section, made up of one or more composite plies 34, is rolled onto the bat-shaped mandrel. A bond-inhibiting layer 36 may then be rolled onto the inner wall section, if such a layer is desired. An inner layer 24, made up of one or more composite plies, of an outer wall section is then rolled onto the bond-inhibiting layer 36, or onto the inner wall section if a bond-inhibiting layer is not employed.

Next, the layers of the interface section 26 are applied. First, an inner resin-impregnated reinforcement layer 32 is rolled onto the inner layer 24 of the outer wall section. One or more layers 28 of substantially dry fabric are then rolled onto the inner resin-impregnated reinforcement layer 32. An outer resin-impregnated reinforcement layer 30 is then rolled onto the fabric layer 28.

Finally, an outer layer 22 of the outer wall section, made up of one or more composite plies, is rolled onto the outer resin-impregnated reinforcement layer 30. Once all of the layers are arranged, heat and pressure are applied to the layers to cure the bat 10, as described above.

The described bat construction, and method of making the same, provides a bat having excellent "trampoline effect" and durability. These results are primarily due to the use of an interface section including one or more dry fabric layers sandwiched between layers of a resin-impregnated composite material in the bat barrel. The resin flow from the composite layers into the fabric layer provides for increased stiffness and trampoline effect. Additionally, the blending of barrel layers in a single curing step provides for increased durability, especially during impact at the extreme ends of the barrel layers.

In any of the embodiments described herein, one or more layers of non-resin-impregnated fabric may be placed at various other locations within the barrel to increase barrel stiffness and to improve "trampoline effect." Additionally, the fabric layers may be placed adjacent to one another, or may be separated from one another by a suitable separation means.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel, a handle, and a tapered section joining the barrel to the handle, with the barrel comprising:

an outer barrel wall comprising:

an outer layer;

an inner layer;

an interface section located between the outer layer and the inner layer, the interface section comprising a layer of fabric sandwiched between a plurality of resin-impregnated composite plies, wherein the layer of fabric includes resin that flowed from the plurality of resin-impregnated composite plies during curing of the bat.

2. The ball bat of claim 1 wherein the outer layer has a radial thickness substantially equal to a radial thickness of the inner layer, such that the interface section is located substantially at a radial midpoint of the outer barrel wall.

3. The ball bat of claim 1 with the barrel further comprising an inner barrel wall adjacent to and surrounded by the inner layer of the outer barrel wall.

4. The ball bat of claim 3 further comprising a bond-inhibiting layer separating the inner barrel wall from the inner layer of the outer barrel wall.

5. The ball bat of claim 3 wherein the inner barrel wall has a radial thickness substantially equal to a radial thickness of the outer barrel wall.

6. The ball bat of claim 5 wherein the outer layer of the outer barrel wall has a radial thickness substantially equal to the radial thickness of the inner layer of the outer barrel wall, such that the interface section is located substantially at a radial midpoint of the outer barrel wall, and at approximately one quarter the combined radial wall thickness of the outer barrel wall and the inner barrel wall measured from an outer surface of the outer barrel wall.

7. The ball bat of claim 1 wherein the outer and inner layers of the outer barrel wall each comprise at least one ply of a composite material.

8. The ball bat of claim 7 wherein the composite material comprises a fiber-reinforced resin.

9. The ball bat of claim 7 wherein the composite material includes at least one material selected from the group consisting of glass, graphite, boron, carbon, aramid, ceramic, and kevlar.

10. The ball bat of claim 1 wherein each of the resin-impregnated composite plies of the interface section comprises a unidirectional composite tape.

11. The ball bat of claim 10 wherein a relative pressure in the unidirectional composite tape is greater than a pressure in the fabric layer prior to curing of the interface section, such that resin flows from the unidirectional composite tape into the fabric layer during curing.

12. A method of constructing a ball bat, comprising the steps of:

placing a layer of substantially dry fabric between a plurality of resin-impregnated layers to form a substantially cylindrical interface section;

placing the interface section between a plurality of outer wall sections, the outer wall sections comprising a first plurality of composite plies;

applying heat and pressure to the interface section and to the composite plies to induce a flow of resin from the resin-impregnated layers into the fabric layer, thereby forming a bat having a barrel comprised of the interface section and portions of the outer wall sections adjacent to the interface section.

13. The method of claim 12 wherein a relative pressure in the resin-impregnated layers is greater than a pressure in the fabric layer prior to the step of applying heat and pressure.

14. The method of claim 12 further comprising the step of positioning the outer wall sections around an inner wall section comprising a second plurality of composite plies prior to the step of applying heat and pressure.

15. The method of claim 14 further comprising the step of positioning a bond-inhibiting layer between the outer wall sections and the inner wall section prior to the step of applying heat and pressure.

16. A method of constructing a ball bat, comprising the steps of:

rolling an inner composite wall section onto a mandrel;

rolling a bond-inhibiting layer onto the inner wall section;

rolling an inner layer of an outer composite wall section onto the bond-inhibiting layer;

rolling a first resin-impregnated reinforcement layer onto the inner layer of the outer wall section;

rolling a layer of substantially dry fabric onto the first resin-impregnated reinforcement layer;

rolling a second resin-impregnated reinforcement layer onto the fabric layer;

rolling an outer layer of the outer composite wall section onto the second resin-impregnated reinforcement layer;

applying heat and pressure to induce a flow of resin from the first and second resin-impregnated reinforcement layers into the fabric layer.

17. The method of claim 16 wherein a relative pressure in the first and second resin-impregnated reinforcement layers is greater than a pressure in the fabric layer prior to the step of applying heat and pressure.

18. A ball bat, comprising:

a barrel, a handle, and a tapered section joining the barrel to the handle, the barrel including an outer wall;

an interface section located in the outer wall of the barrel, the interface section comprising a layer of previously non-resin-impregnated fabric sandwiched between a plurality of resin-impregnated layers, wherein the layer of fabric includes resin that flowed from the Plurality of resin-impregnated layers during curing of the bat.

19. The ball bat of claim 18 with the barrel further comprising an inner wall located within and adjacent to the outer wall.

20. The ball bat of claim 19 further comprising a bond-inhibiting layer separating the inner wall from the outer wall.

21. The ball bat of claim 18 wherein the interface section is located substantially at a radial midpoint of the outer wall.

22. The ball bat of claim 18 wherein the outer wall comprises at least one ply of a composite material.

* * * * *